United States Patent [19]

Parrott

[11] Patent Number: 4,755,002

[45] Date of Patent: Jul. 5, 1988

[54] MINING MACHINE

[75] Inventor: George A. Parrott, Sandal, England

[73] Assignee: Dosco Overseas Engineering Ltd., Nottinghamshire, England

[21] Appl. No.: 930,651

[22] Filed: Nov. 13, 1986

[30] Foreign Application Priority Data

Nov. 23, 1985 [GB] United Kingdom ..... 8528917

[51] Int. Cl.[4] ..... E21C 25/60; E21C 27/24

[52] U.S. Cl. ..... 299/81; 299/17

[58] Field of Search ..... 299/81, 17, 75, 55; 239/101

[56] References Cited

U.S. PATENT DOCUMENTS

| | | | |
|---|---|---|---|
| 3,799,615 | 3/1974 | Taylor et al. | 299/81 X |
| 4,049,318 | 9/1977 | Fruin | 299/81 |
| 4,314,730 | 2/1982 | Plumpton et al. | 299/81 X |
| 4,647,112 | 3/1987 | Demovlin et al. | 299/81 |

FOREIGN PATENT DOCUMENTS

| | | | |
|---|---|---|---|
| 0176235 | 2/1986 | European Pat. Off. . | |
| 284933 | 3/1971 | U.S.S.R. | 299/81 |
| 481698 | 7/1976 | U.S.S.R. | 299/81 |

*Primary Examiner*—Stephen J. Novosad
*Assistant Examiner*—David J. Bagnell
*Attorney, Agent, or Firm*—Trexler, Bushnell, Giangiorgi & Blackstone, Ltd.

[57] ABSTRACT

A roadheader type mining machine (1) comprises a self-propelled chassis (6), an elongate boom (9) having a longitudinal axis (10), rotary cutting head (15) having a plurality of water spray nozzles (17). The boom (9) is of a two-part construction comprising an inner part (18) that is non-rotatable about the boom longitudinal axis (10), that is supported from one end (8) on the chassis (6), and that carries towards its other end (14) bearing means (19) for rotatably supporting an outer part (20) that axially extends from said inner part (18). Power means (59) is carried by the non-rotatable part (18) to rotate the rotatable part (20) about the boom longitudinal axis, while the rotatable part (20) is provided with pumping means (39) and a bearing ring (50) that is carried by the rotatable part (20) eccentrically with respect to the axis (10), whereby phased water supply to the nozzles (17) is controlled by suitable angular rotation of the rotatable part (20) about the axis (10) to cause consequent rotation of the ring (50).

11 Claims, 4 Drawing Sheets

MINING MACHINE

This invention relates to a mining machine of the kind adapted to drive underground roadways, tunnels or headings, commonly known as a roadheader machine.

Basically, such a machine comprises a self-propelled crawler, or wheel-mounted chassis carrying a manoeuverable boom, a terminal end of which is provided with a rotary cutting head, the latter being driven from a power unit carried by the chassis, via a transmission including a final drive shaft extending internally and longitudinally of the boom, within a stationary outer casing, and rotatably supported in bearings carried by the outer casing of the boom. The boom is power-manoeuverable e.g. hydraulically, under the control of the machine operator, so that the boom follows the profile required for the roadway etc. Basically, the end of the boom distal from the cutting head is mounted on a pin joint, for swinging manoeuvers in a vertical plane and about a horizontal axis (assuming the machine is located on level ground), with the pin joint mounted on a turntable arrangement for swinging manoeuvers in a horizontal plane.

Apart from the cutting heads being provided with replaceable cutter picks, they are also provided with a plurality of nozzles to emit a water spray or jet, while the nozzles may in practice be mounted on the heads and/or on the picks. The water spray or jet may be for purposes such as pre-start warning, dust suppression, pick face flushing, incendive sparking elimination and, at higher pressures, water jet assisted cutting. It will be appreciated however that only a certain sector of the periphery of the cutting head is in the cut at any one time and consequently if, as is usually the case, water is emitted over 360°, a substantial proportion of the water e.g. 50%, has no beneficial effect but represents a waste of the power consumed in generating the pressure (which, in the case of water jet assisted cutting, may be of the order of 30,000 p.s.i.), apart from creating unnecessarily wet floor conditions. Attempts have been made to provide valving arrangements to achieve phased emission, but such systems have yet to be proved and are relatively complex to instal, maintain and adjust.

In our co-pending European Patent Application No. 85306000.2, is described a roadheader type mining machine in which the emission of water sprays or jets may be readily phased in a desired radially extending sector by simple control of valving arrangements, basically by surrounding at least a portion of the boom with a collar rotatable about the boom longitudinal axis by power means to a selected position, the collar carrying, and/or positionally controlling, valve actuation means whereby periodic water supply to the nozzles, due to head rotation, within a selected radial sector is controllable by the valves, phased activation of which is controlled by positional adjustment of the collar to provide appropriate positional adjustment of the valve actuation means.

The present invention is aimed at providing an alternative constructional system to attain the same objective, that is, the provision of a readily adjustable and/or controllable phasing system.

The present invention, is directed to a roadheader type mining machine comprising a self-propelled chassis, an elongate boom having a longitudinal axis, the boom being supported by the chassis for powered positional adjustment with respect to the chassis, a terminal end of the boom provided with a rotary cutting head drivable by a transmission, including a final drive shaft, coaxial with the boom longitudinal axis, the cutting head having a plurality of nozzles each to emit a water spray or jet, with water supplied to the nozzles along conveying conduits, which machine is per se known. The invention resides basically in the provision of a two-part boom construction of this known machine, the boom an inner part that is non-rotatable about the boom longitudinal axis, that is supported from one end on the chassis, and that carries towards its other end bearing means for rotatably supporting an outer part and power means carried by the non-rotatable part to rotate the rotatable part about the boom longitudinal axis. The final drive shaft is located at least partially within the rotatable part and provided with at least one radially extending cylinder having a closed inner end and an open outer end. In a manner known per se, each cylinder at least partially housing a piston which is reciprocable within its cylinder, with a variable volume, pressure-generating chamber defined between a radially inner end of the piston and a closed, inner end of its cylinder, and with the radially outer end of each piston being in direct or indirect contact with an inner profile of a bearing ring carried by the rotatable part eccentrically with respect to the boom longitudinal axis, such that upon rotation of the drive shaft, variations in radial distance of the inner profile from the axis of rotation of the drive shaft cause reciprocation of each piston, and a consequent pumping effect, and in accordance with the invention a phased supply to the nozzles is controlled by suitable angular rotation of the rotatable part about the boom longitudinal axis to cause consequent rotation of the ring.

Thus, the invention provides a roadheader type mining machine in which water phasing only to a selected radial sector (the cutting sector) of the cutting head, is readily attained simply by appropriate repositioning (by rotation) of the rotatable part from a previous angular position (appropriate to a previously selected sector) to a new, static, position that results in phased water emission over only the newly selected sector, thereby maximising the efficient use of water. Thus, with the rotary cutting head removing rock from say a left hand vertical wall from a roadway being advanced, and consequently with the rotatable part of the boom being so positioned as to attain water emission over the cutting sector of the cutting head i.e. the sector within the cut, displacement of the boom for the cutting of the right hand vertical wall will require rotation of the rotatable part of the boom through 180° from its previous position in order to achieve water emission from the new cutting sector of the cutting head now within the cut.

Conveniently, power to the transmission is provided by a prime mover e.g. an electric or hydraulic motor, carried by the non-rotatable part of the boom. Preferably, such prime mover comprises an electric motor located within the non-rotatable part of the boom, and having an axis of rotation coincident with the longitudinal axis of the non-rotatable part.

Preferably, speed reduction gearing is incorporated within the boom. Such gearing may take the form of an epicyclic reduction stage. If further speed reduction is required, then the output of a first epicyclic reduction stage may be directed to a second epicyclic reduction stage. With any arrangement, the speed reduction gearing is preferably located within the rotatable part of the boom.

It is also preferred for the bearing means between the non-rotatable and rotatable parts of the boom to consist of a plain journal bearing, and preferably two journal bearings that are axially spaced apart.

Although in theory any convenient power means may be employed to achieve rotation of the rotatable part of the boom, preferably a worm and wheel arrangement is employed. In detail, the arrangement may comprise a worm drivable by an hydraulic motor. Preferably, two parallel, spaced-apart worms in drivable mesh with a common wheel are employed, to engage the wheel at two 180° spaced locations. A shaft of the hydraulic motor(s) may project outwardly, so as to indicate the boom position.

Re-positioning of the rotatable part of the boom, to result in sector selection variations, to suit positional variations of the boom and hence the cutting head, may be controlled by any of several alternative procedures. Thus, in its simplest form, rotation may be controlled manually by activation of hand controls by the machine operator, provided the machine operator has sight of the cutting head and/or the boom. Alternatively, automatic rotational control may be effected by attaching transducers to the boom (to register directionally, load or stresses within the boom) and/or the cutting head and/or the cutting picks and/or the conventional hydraulic control circuitry of the boom (to register flow and/or pressure changes) to sense the sector of the cutting head that is effecting cutting, the transducers being connected to electrical and/or hydraulic control circuitry to instigate rotation. In detail, the transducers may be of a pressure sensing kind and/or a movement sensing kind. As a further alternative, the boom may be provided with a trailing arm or a link mechanism in contact with the cut, to sense the location of the cut and hence the sector of the cutting head that is effecting cutting, with rotation, to achieve its desired re-positioning, being controlled through suitable control circuitry by movements of the arm or link mechanism. Finally, if the machine is of a kind provided with a micro-processor which retains a profile cutting pattern program, then this program may be modified to control additionally positioning, as the sector in the cut is predetermined.

Conveniently, water from a pressure supply source (e.g. at 100–1,000 p.s.i. or higher), is conveyed along a supply conduit drilled along the longitudinal axis of the drive shaft, the supply conduit terminating at a distribution block within the cutting head and being intersected by a plurality of radiating supply conduits and associated non-return valves and serving both the pistons and the nozzles or group of nozzles.

The invention will now be described in greater detail by way of example, with reference to the accompanying drawings, in which.

Figure 1:
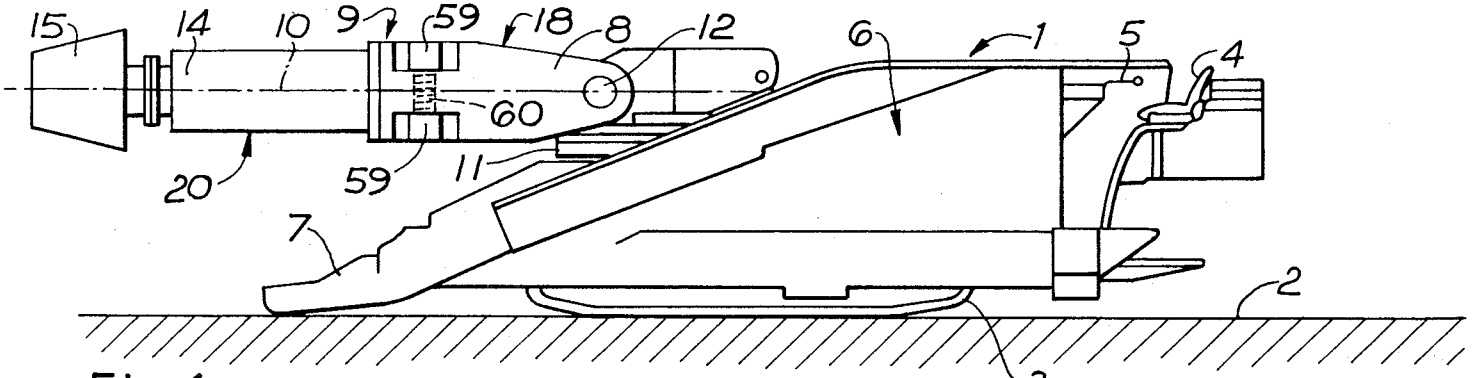
FIG. 1 is a side elevation of a roadheader type mining machine.
Figure 2:
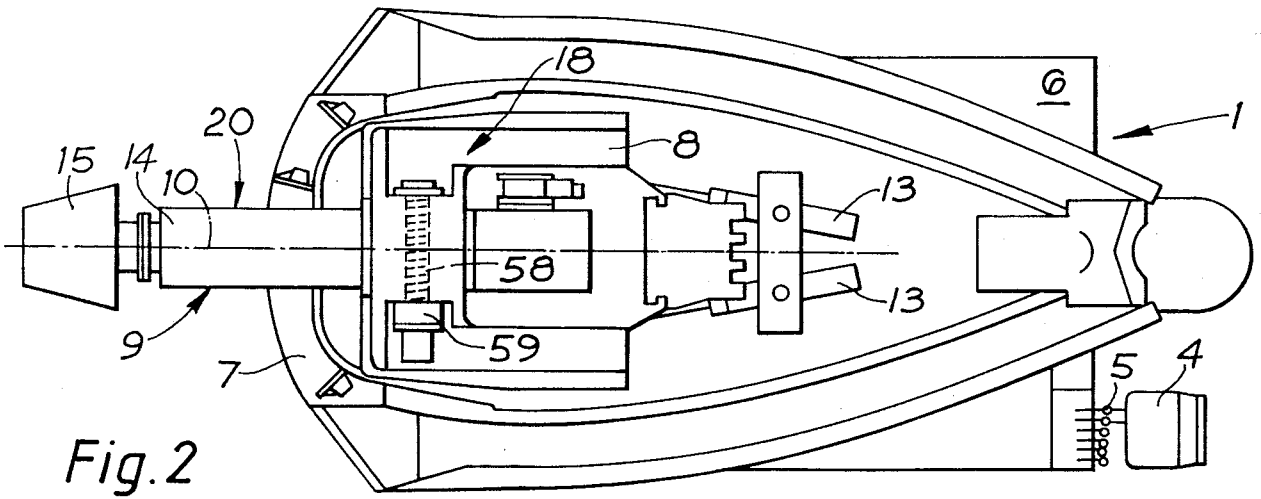
FIG. 2 is a plan view of FIG. 1.

In the drawings, a roadheader type mining machine 1 is shown seated on a mine floor 2 over which the machine is manoueverable on crawler tracks 3 under the control of a machine operator, an operator's seat being indicated at 4 and a bank of control valves at 5.

Figure 3:
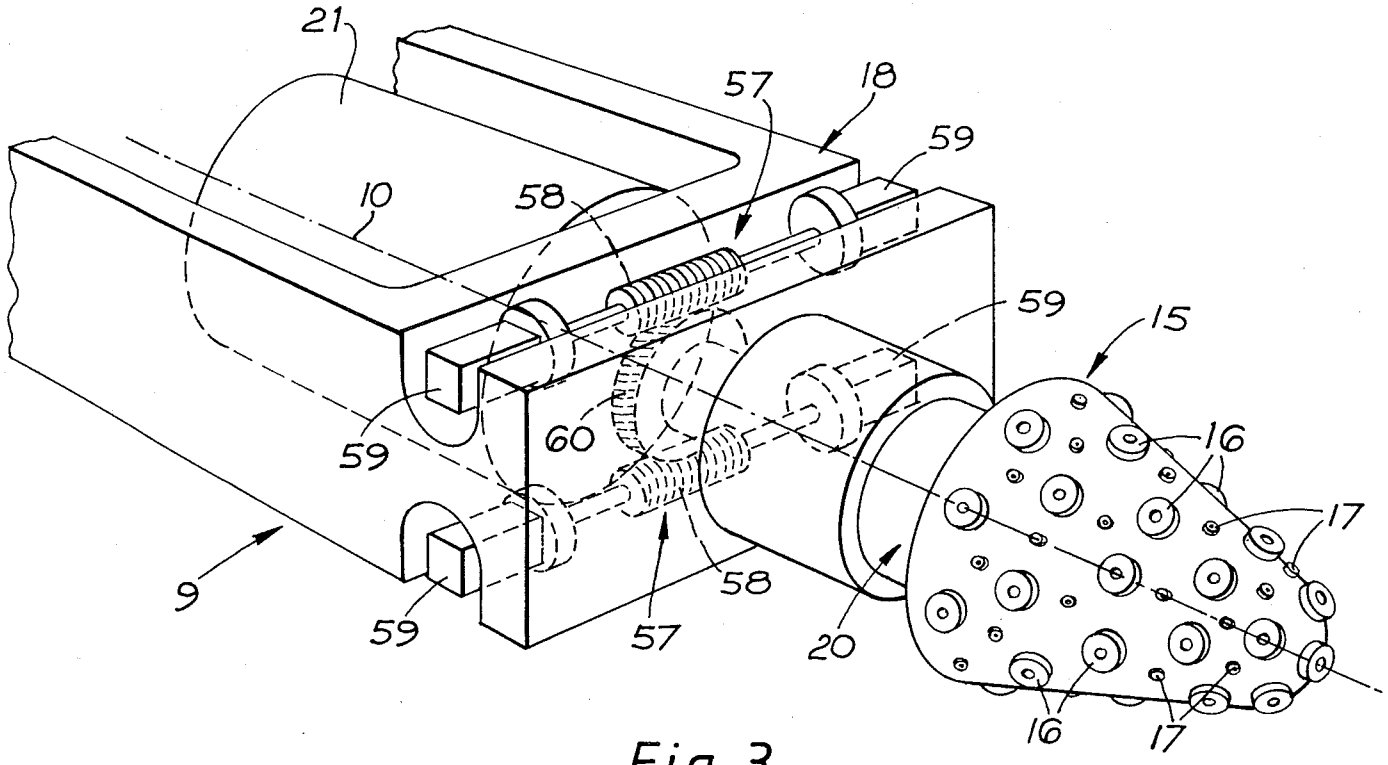
FIG. 3 is a perspective view of the end of the boom of the machine of FIGS. 1 and 2, remote from the machine.

The machine 1 comprises a chassis 6 provided with a spoil gathering/loading conveyor 7 and carrying one end 8 of an elongate boom 9 having a longitudinal axis 10, the boom 9 being mounted on a turn-table arrangement 11 for swinging movements about a vertical axis, and on pivot pins 12 for swinging movements about a horizontal axis, such movements being powered in the known manner by hydraulic rams 13 under operator's control via the valves 5. At its other end 14 the boom 9 is provided with a cutting head 15 rotatable about the boom axis 10 and provided with a plurality of cutter picks releasably retained in pick boxes 16 and associated water spray nozzles 17 to emit a water spray or jet, (FIG. 3). The chassis 6 also carries a power unit in the form of an electric motor (not shown) to power a hydraulic pump(s) (not shown) for various hydraulic functions of the machine 1, including drive to the tracks 3.

Figure 4:
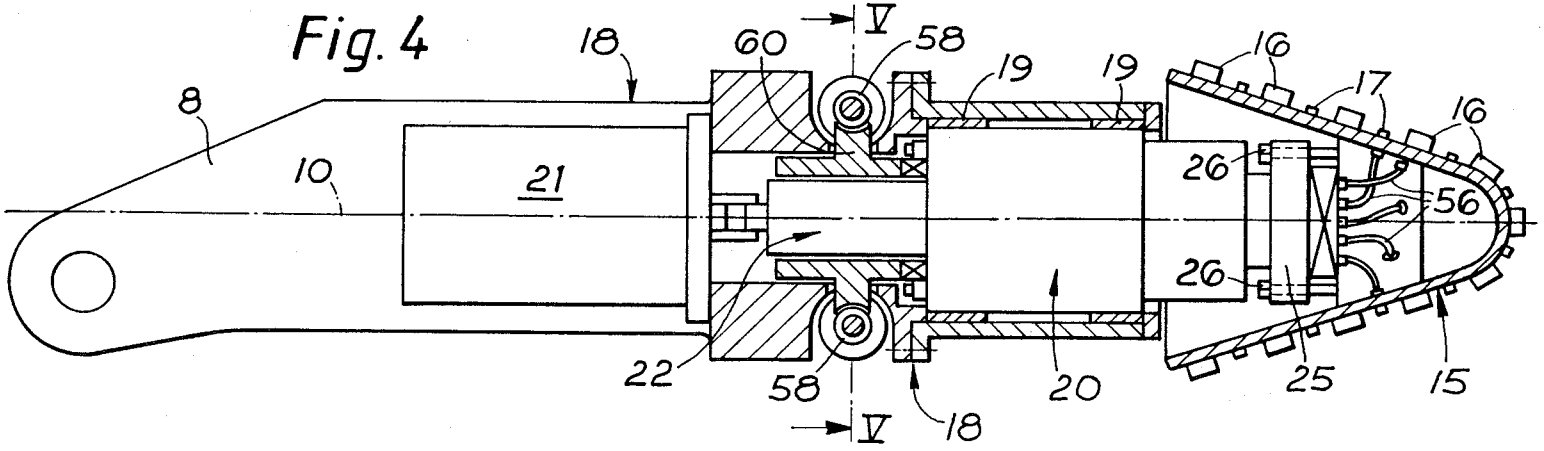
FIG. 4 is a diagrammatic, axial sectional view along the boom of FIG. 3.
Figure 5:
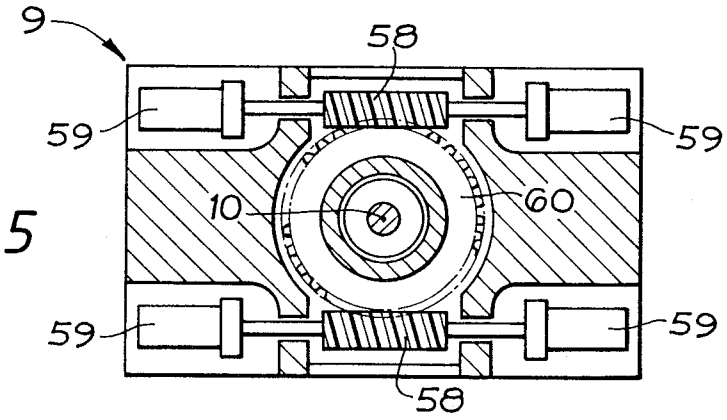
FIG. 5 is a section on the line V—V of FIG. 4.
Figure 6:
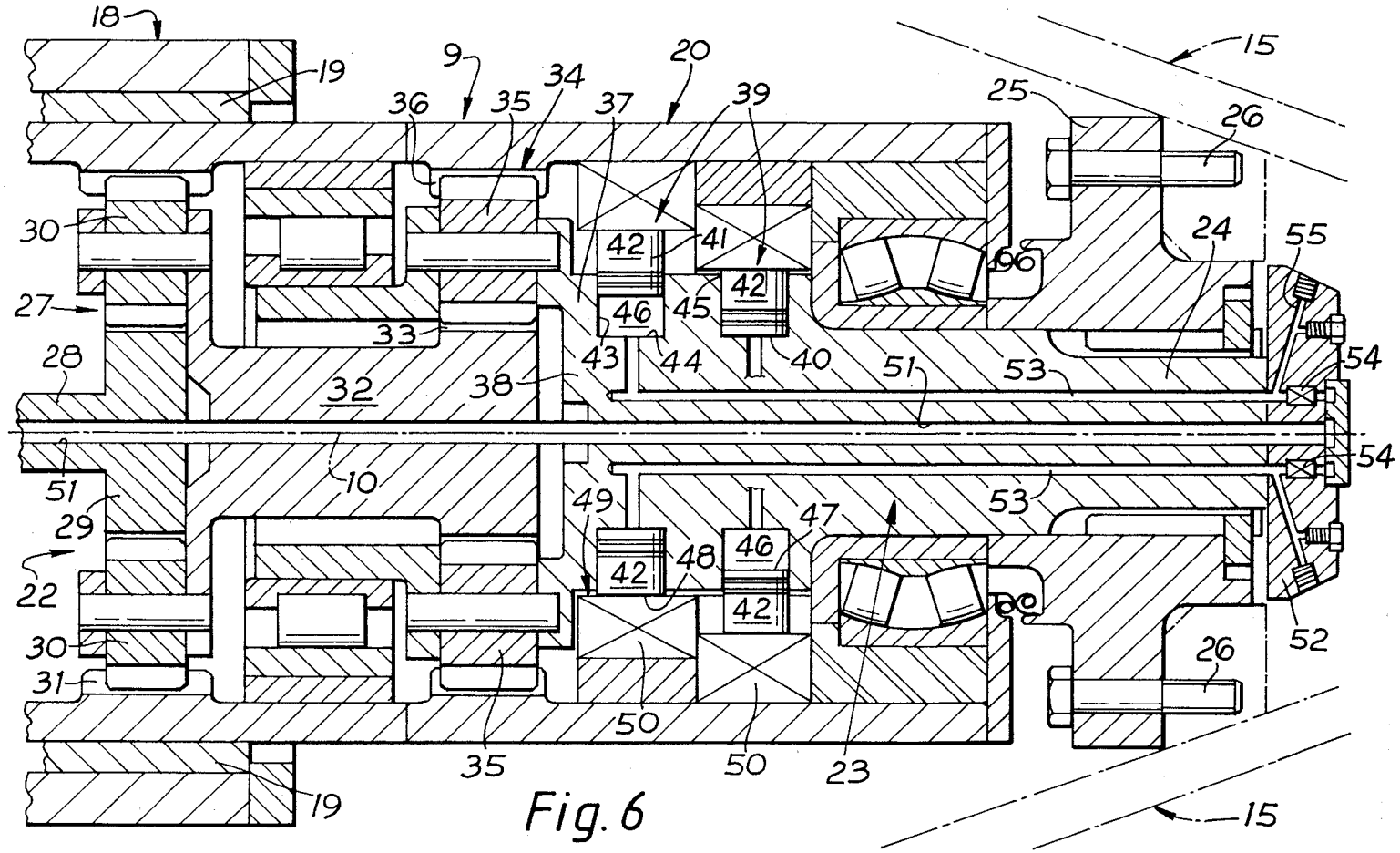
FIG. 6 is an axial sectional view to an enlarged scale along the boom of FIGS. 3 to 5.

As best seen in FIGS. 3 and 4, the boom 9 is of a two-part construction comprising one part 18 that is non-rotatable about the boom longitudinal axis 10, which part 18 carries towards its outer end bearing means in the form of two axially spaced-apart journal bearings 19 for rotatably supporting another part 20 that is rotatable with respect to the inner part 18 about the boom longitudinal axis 10 by a power means 21, in the form of an electric motor having an axis of rotation co-incident with the boom axis 10 and carried by the non-rotatable part 18. A transmission 22 extends from the power means 21 to the cutting head 15, and as detailed in FIG. 6 comprises a final drive shaft 2 located at least partially within the rotatable part 20, co-axial with the boom longitudinal axis 10, and projecting therefrom, having a splined terminal end 24 on which is mounted a correspondingly splined mounting ring 25 to which the head 15 is secured by bolts 26.

The transmission 22 also comprises a first epicyclic reduction stage 27 comprising an input shaft 28, a sun wheel 29, planet wheels 30, an annulus 31 and a carrier shaft 32, the latter having a sun wheel 33 of a second epicyclic reduction stage 34, which also includes planet wheels 35, an annulus 36 and a carrier 37 formed integrally with an end 38 of the final drive shaft 23 remote from the cutting head 15.

The final drive shaft 23 is also provided with pumping means 39 to intensify a low pressure water supply to a high pressure water supply to be emitted by the nozzles 17. In detail, the pumping means 39 comprises two banks 40, 41 of multiple radial pistons 42, each reciprocally located in one radially extending cylinder 43 having a closed inner end 44 and an open outer end 45, with a variable volume, pressure-generating chamber 46 defined between a radially inner end 47 of each piston 42 and the closed, inner end 44 of its cylinder 43. A radially outer end 48 of each piston 42 is in direct or indirect permanent contact with an inner profile 49 of a bearing ring 50 carried by the rotatable part 20 and located eccentrically with respect to the boom axis 10, such that upon rotation of the drive shaft 23, variations in radial distance of the inner profile 49 from the axis 10 cause reciprocation of each piston 42, and a consequent pumping effect. Low pressure water is supplied to the pumping means 39 from a remote pump (not shown) along a supply bore 51 co-axial with the boom axis 10 and passing through the input shaft 28, carrier shaft 32 and final drive shaft 23 into a distribution block 52 in fluid flow connection with transfer ports 53, each with a non-return valve 54, extending axially and then radially along the final drive shaft 23 to each pressure generating chamber 46, with, upon the pressure stroke, water being returned along the transfer ports 53 but because of the presence of the valves 54 being directed into radiating supply conduits 55 and then via piping 56 (FIG. 4) to the nozzles 17 or groups of nozzles 17.

Phased supply to the nozzles 17, to achieve water emission over only a prescribed sector of the cutting head 15, is controlled by suitable angular rotation and repositioning, between selected static positions, of the rotatable part 20 with respect to the non-rotatable part 18 about the longitudinal axis 10 of the boom to cause consequent rotation of the bearing rings 50, and such rotation is achieved by a power means in the form of worm and wheel arrangement 57 comprising upper and lower worms 58 rotatable about parallel axes by hydraulic motors 59, the worms being in drivable mesh with a common wheel 60 at two 180° spaced locations.

In its simplest form, rotational repositioning of the rotatable part 20 may be controlled manually by activation of hand controls such as valves 5 by the machine operator.

What I claim is:

1. A roadheader type mining machine comprising a self-propelled chassis, an elongate boom having a longitudinal axis, said boom being supported at one end by said chassis for powered positional adjustment with respect to said chassis, and a rotary cutting head provided on the other end of said boom, a transmission to drive said rotary cutting head and a final drive shaft located, coaxially with said boom longitudinal axis forming part of said transmission, a plurality of nozzles provided on said cutting head each to emit a water spray or jet, conveying conduits to supply water to said nozzles, said boom being of a two-part construction comprising an inner part that is non-rotatable about said boom longitudinal axis, that is supported from said one end on said chassis, and bearing means carried towards its other end for rotatably supporting an outer part that axially extends from said inner part, and power means carried by said non-rotatable part to rotate the rotatable part about said boom longitudinal axis; said cutting head being supported on said outer boom part and mounted rotatably with respect to said outer boom part; said final drive shaft being located at least partially within said rotatable part and provided with at least one radially extending cylinder having a closed inner end and an open outer end, a piston housed at least partially and in a reciprocable manner within said cylinder(s), with a variable volume, pressure-generating chamber defined between a radially inner end of said piston and a closed, inner end of its cylinder, a bearing ring carried by said rotatable part eccentrically with respect to said boom longitudinal axis, and with a radially outer end of each piston being in direct or indirect contact with an inner profile of said bearing ring such that upon rotation of said drive shaft, variation in radial distance of said inner profile from said boom longitudinal axis cause reciprocation of said piston(s), and a consequent pumping effect, with phased supply to said nozzles being controlled by suitable angular rotation of said rotatable part about said boom longitudinal axis to cause consequent rotation of the bearing ring.

2. A machine as claimed in claim 1, wherein a prime mover is carried by said non-rotatable part to power said transmission.

3. A machine as claimed in claim 2, wherein said prime mover comprises an electric motor and having an axis of rotation coincident with said boom longitudinal axis.

4. A machine as claimed in claim 1, wherein speed reduction gearing is incorporated within said boom.

5. A machine as claimed in claim 4, wherein said gearing takes the form of an epicyclic reduction stage.

6. A machine as claimed in claim 5, wherein output of a first epicyclic reduction stage is directed to a second epicyclic reduction stage.

7. A machine as claimed in claim 4, wherein said speed reduction gearing is located within said rotatable part of the boom.

8. A machine as claimed in claim 1, wherein said bearing means between said non-rotatable and rotatable parts of said boom comprises two journal bearings that are axially spaced apart.

9. A machine as claimed in claim 1, wherein a worm and wheel arrangement is employed as said power means to achieve rotation of said rotatable part, comprising two parallel, spaced-part worms in drivable mesh with a common wheel to engage said wheel at two 180° spaced locations.

10. A machine as claimed in claim 1, comprising hand controls for repositioning of said rotatable part of the boom, to result in sector selection variations.

11. A machine as claimed in claim 1, wherein water from a pressure supply source is conveyed along a supply conduit drilled along said longitudinal axis of said final drive shaft, provided at one terminal end of a distribution block said supply conduit said distribution block being located within said cutting head, a plurality of radiating supply conduits intersecting said supply conduit, and associated non-return valves serving both said pistons and said nozzles.

* * * * *